United States Patent [19]

Papay

[11] 4,228,020

[45] Oct. 14, 1980

[54] LUBRICATING OIL COMPOSITION

[75] Inventor: Andrew G. Papay, Manchester, Mo.

[73] Assignee: Edwin Cooper, Inc., St. Louis, Mo.

[21] Appl. No.: 36,074

[22] Filed: May 4, 1979

[51] Int. Cl.[2] ..... C10M 1/46; C10M 1/10; C10M 3/40; C10M 3/02

[52] U.S. Cl. ..... 252/29; 252/49.8

[58] Field of Search ..... 252/29, 49.8

[56] References Cited

U.S. PATENT DOCUMENTS

| | | | |
|---|---|---|---|
| 4,094,799 | 6/1978 | DeVries et al. | 252/29 |
| 4,158,633 | 6/1979 | Papay | 252/49.8 |

*Primary Examiner*—Delbert E. Gantz
*Assistant Examiner*—Irving Vaughn
*Attorney, Agent, or Firm*—Donald L. Johnson; Robert A. Linn; Joseph D. Odenweller

[57] ABSTRACT

Friction of internal combustion engines is reduced by using a crankcase motor oil containing the combination of graphite and a di-lower alkyl hydrocarbyl phosphonate, e.g. dimethyloctadecylphosphonate.

4 Claims, No Drawings

LUBRICATING OIL COMPOSITION

BACKGROUND OF THE INVENTION

In order to conserve energy, automobiles are now being engineered to give improved gasoline mileage compared to those in recent years. This effort is of great urgency as a result of Federal regulations recently enacted which compel auto manufacture to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

Use of graphite in motor oil is disclosed in U.S. Pat. No. 4,094,799. Likewise, dimethyl hydrocarbyl phosphonates have been used in crankcase motor oil to reduce friction (U.S. patent application Ser. No. 891,591, filed Mar. 30, 1978, U.S. Pat. No. 4,158,633.

SUMMARY

According to the present invention engine friction is reduced by using an oil in the crankcase containing both graphite and a di-lower alkyl hydrocarbyl phosphonate. It has been found that not only are the effects of these two components not additive, but tests have shown that friction reduction is greater than the sum of the individual effects.

DESCRIPTION OF THE PREFERRED EMBODIMENTS

A preferred embodiment of this invention is a lubricating composition suitable for use in the crankcase of an internal combustion engine, said composition comprising a major amount of a lubricating oil and a minor friction-reducing amount of the combination of graphite and a di-lower alkyl $C_{6-36}$ hydrocarbyl phosphonate.

Graphite-containing oils are described in U.S. Pat. No. 4,094,799, incorporated herein by reference.

The di-lower alkyl $C_{12-36}$ hydrocarbyl phosphonate are compounds having the structure

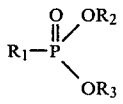

in which $R_1$ is a hydrocarbon group containing 6–36 carbon atoms and $R_2$ and $R_3$ are lower alkyl groups. $R_1$ can be alkyl, alkenyl, alkaryl, cycloalkyl, aryl, or aralkyl. Representative examples of these compounds are:

dimethyl n-hexylphosphonate
diethyl n-dodecylphosphonate
diisobutyl 1-methyl undecylphosphonate
methyl ethyl 2-ethylhexylphosphonate
methyl isopropyl n-octadecylphosphonate
dimethyl n-octadecylphosphonate
di-sec-butyl 1-ethyl eicosylphosphonate
di-n-hexyl n-docosylphosphonate
dimethyl n-triacontylphosphonate
dimethyl n-hexatriacontylphosphonate
diethyl n-dodecenylphosphonate
diisopropyl 2-ethyl octadecenylphosphonate dimethyl n-triacontenylphosphonate
methyl isopropyl 1-hexyltriacontenylphosphonate
dimethyl cyclohexylphosphonate
di-tert-butyl 4-tert-butyl cyclohexylphosphonate
dimethyl phenylphosphonate
di-tert-butyl 4-methylphenylphosphonate
dimethyl naphthylphosphonate
methyl tert-butyl 4-tert-butylphenylphosphonate
dimethyl benzylphosphonate
di-n-propyl 4-tert-butylphenylphosphonate
and the like.

More preferably $R_1$ is an aliphatic hydrocarbon group containing about 12–36 carbon atoms. These include both alkyl and alkenyl groups. Still more preferably $R_1$ is an alkyl group containing about 12–36 carbon atoms and $R_2$ and $R_3$ are lower alkyl groups containing 1–4 carbon atoms. Examples of these additives are:

dimethyl n-dodecylphosphonate
diethyl 1-methyl tridecylphosphonate
methyl ethyl n-hexadecylphosphonate
methyl isobutyl n-octadecylphosphonate
diisopropyl n-tetracosylphosphonate
dimethyl n-hexatriacontylphosphonate
dimethyl 1-methyl pentatriacontylphosphonate
and the like.

In a highly preferred embodiment both $R_2$ and $R_3$ are methyl groups and $R_1$ is an alkyl group containing 12–36 carbon atoms. The most preferred phosphonate coadditive is dimethyl octadecylphosphonate.

The additives can be used in mineral oil or in synthetic oils of viscosity suitable for use in the crankcase of an internal combustion engine. Crankcase lubricating oils have a viscosity up to about 80 SUS at 210° F. According to the present invention the combination of graphite and di-lower alkyl $C_{6-36}$ hydrocarbylphosphonates function to increase fuel economy when added to lubricating oil compositions formulated for use in the crankcase of internal combustion engines. Similar mileage benefits could be obtained in both spark ignited and diesel engines. A useful concentration is about 0.05–1% of the phosphonate and 0.005–1% of graphite.

Crankcase lubricating oils of the present invention have a viscosity up to about SAE 40. Sometimes such motor oils are given a classification at both 0° and 210° F., such as SAE 10W or SAE 5W 30.

Crankcase lubricants of the present invention can be further identified since they usually contain a zinc dihydrocarbyl dithiophosphate (ZDDP) in addition to the phosphonate additive. Likewise, these crankcase lubricants contain an alkaline earth metal sulfonate such as calcium petroleum sulfonate, calcium alkaryl sulfonate, magnesium petroleum sulfonate, magnesium alkaryl sulfonate, barium petroleum sulfonate, barium alkaryl sulfonate and the like.

Mineral oils include those of suitable viscosity refined from crude oil from all sources including Gulfcoast, midcontinent, Pennsylvania, California, Alaska and the like. Various standard refinery operations can be used in processing the mineral oil. Synthetic oil includes both hydrocarbon synthetic oil and synthetic esters. Useful synthetic hydrocarbon oils include liquid polymers of $\alpha$-olefins having the proper viscosity. Especially useful are the hydrogenated liquid oligomers of $C_{6-12}$ $\alpha$-olefins such as $\alpha$-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetraceproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 5–25 wt % hydrogenated α-decene trimer with 75–95 wt % 150 SUS (100° F.) mineral oil results in an excellent lubricant. Likewise, blends of about 5–25 wt % di-(2-ethylhexyl-)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkyl-aryl ZDDP are useful. A typical alkyl-type ZDDP contains a mixture of isobutyl and isoamyl groups. Zinc dinonylphenyldithiophosphate is a typical aryl-type ZDDP. Good results are achieved using sufficient ZDDP to provide about 0.01–0.5 wt % zinc. A preferred concentration supplies about 0.05–0.3 wt % zinc.

Another additive used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 wt % alkaline earth metal and more preferably about 0.1–1.0 wt %. In a most preferred embodiment the lubricating oil composition contains a calcium petroleum sulfonate or alkaryl (e.g. alkylbenzene) sulfonate. Such calcium sulfonates used in combination with the phosphonates described herein give better fuel economy than is obtained with the similar magnesium sulfonates.

Viscosity index improvers can be included such as the polyalkylmethacrylate type or the ethylene-propylene copolymer type. Likewise, styrene-diene VI improvers or styrene-acrylate copolymers can be used. Alkaline earth metal salts of phosphosulfurized polyisobutylene are useful.

Most preferred crankcase oils also contain an ashless dispersant such as the polyolefin substituted succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. No. 3,172,892 and U.S. Pat. No. 3,219,666 incorporated herein by reference.

Another useful class of ashless dispersants are the polyolefin succinic esters of mono- and polyhydroxy alcohols containing 1 to about 40 carbon atoms. Such dispersants are described in U.S. Pat. Nos. 3,381,022 and 3,522,179.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise the succinic amide, imide, and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,793,202; 3,798,165; 3,798,247 and 3,803,029.

The above Mannich dispersants can be reacted with boric acid to form boronated dispersants having improved corrosion properties.

Tests were carried out which demonstrate the friction-reducing properties of the additives when used in a formulated crankcase motor oil in an internal combustion engine. These tests have been found to correlate with fuel economy tests in automobiles. In these tests an engine with its cylinder head removed and with the test lubricating oil in its crankcase was brought to 1800 rpm by external drive. Crankcase oil was maintained at 63° C. to simulate engine operating conditions. The external drive was disconnected and the time to coast to a stop was measured.

The above test was conducted with base oil and base oil containing graphite and a phosphonate alone and in combination. The following table gives the results of these tests in terms of percent increase in coast-down time:

| | % Increase |
|---|---|
| Base oil | — |
| Base oil + 0.5% graphite | 0.28 |
| Base oil + 0.4% phosphonate[1] | 1.83 |
| Base oil + 0.5% graphite + 0.4% phosphonate[1] | 2.33 |

[1]dimethyloctadecylphosphonate

The above results show that the sum of the individual effect of graphite and phosphonate is 2.11%. The actual observed effect is 2.33% which is more than expected. Thus, the combination provides a very effective low-friction crankcase motor oil.

I claim:

1. A lubricating composition suitable for use in the crankcase of an internal combustion engine, said composition comprising a major amount of a lubricating oil and a minor friction-reducing amount of the combination of graphite and a di-lower alkyl $C_{6-36}$ hydrocarbyl phosphonate.

2. A lubricating composition of claim 1 wherein said phosphonate is a dimethyl $C_{12-36}$ aliphatic hydrocarbyl phosphonate.

3. A lubricating composition of claim 2 wherein said phosphonate is a dimethyl $C_{12-36}$ alkylphosphonate.

4. A lubricating composition of claim 3 wherein said phosphonate is dimethyloctadecylphosphonate.

* * * * *